US005974595A

United States Patent [19]

McCabe

[11] Patent Number: 5,974,595

[45] Date of Patent: Nov. 2, 1999

[54] TOILET

[76] Inventor: Robert J. McCabe, 5 Howard Rd., Maynard, Mass. 01754

[21] Appl. No.: 09/175,843

[22] Filed: Oct. 20, 1998

[51] Int. Cl.[6] ..... A47K 13/04

[52] U.S. Cl. ..... 4/248; 4/246.2

[58] Field of Search ..... 4/236, 240, 246.1, 4/246.2, 248

[56] References Cited

U.S. PATENT DOCUMENTS

| | | | |
|---|---|---|---|
| 2,814,049 | 11/1957 | Mercur | 4/241 |
| 3,404,411 | 10/1968 | Newkirk | 4/246.1 |
| 4,378,612 | 4/1983 | Beers | 16/62 |
| 4,551,866 | 11/1985 | Hibbs | 4/248 X |
| 4,766,619 | 8/1988 | Takeda | 4/248 X |
| 4,914,757 | 4/1990 | Johnson | 4/224 |
| 5,060,318 | 10/1991 | Jaskiewicz | 4/248 X |
| 5,153,946 | 10/1992 | Yoke et al. | 4/248 |
| 5,193,228 | 3/1993 | Murasawa et al. | 4/236 |
| 5,267,356 | 12/1993 | Gideon et al. | 4/246.2 |
| 5,279,000 | 1/1994 | Mercier et al. | 4/240 |
| 5,388,281 | 2/1995 | Wiklund et al. | 4/248 |
| 5,419,013 | 5/1995 | Hsiao | 16/319 |

*Primary Examiner*—Robert M. Fetsuga
*Attorney, Agent, or Firm*—Arnold White & Durkee

[57] ABSTRACT

A device for automatically closing an open toilet seat after an adjustable low-speed phase to permit the user to finish using the toilet. The seat then closes at a speed which is adjustable by the user separately from the initial low speed. A biasing member is used to urge the open seat toward the closed position. A pneumatic or hydraulic dampener is mechanically linked to the seat and slows the seat's descent. As the seat rotates toward the closed position it causes a reciprocating member to move inside the dampener. As the reciprocating member moves it forces a dampening fluid to flow from the main chamber of the dampener, through one or both of two openings, to a low pressure area within the dampener. During the low-speed phase, the reciprocating member blocks and prevents the flow of the dampening fluid through one of the openings. This heavily restricted flow allows the seat to move very slowly at first. After the reciprocating member passes and uncovers the second opening, the dampening fluid flows more easily. This permits the seat to travel at a faster speed until it comes to rest on the bowl.

The dampener includes valves to vary the size of the two openings to the low pressure area. In this manner the valves adjust the duration of the low-speed phase and the final descent speed of the seat.

The dampener also includes a check valve in the reciprocating member which permits the seat to be raised with no resistance from the dampener.

27 Claims, 11 Drawing Sheets

TOILET

FIELD OF THE INVENTION

The present invention relates generally to apparatus for closing toilet seats and, more particularly, relates to a compact apparatus for closing a toilet seat with a very slow initial speed, providing a time delay, and a final, controlled descent speed, both speeds being separately adjustable.

BACKGROUND OF THE INVENTION

It is well-known that toilet seats can be a source of disputes in the home where men, after using the toilet as a urinal, leave the seat in the "up" position, which can anger women who must lower the seat before using the toilet. Even worse, a person inattentive to the seat's position might accidentally sit upon the bowl while the seat is up and injure himself. Finally, when the seat is left up, household pets have easy access to the water in the bowl and will frequently drink from it.

Many attempts have been made to alleviate these problems by automating the seat-closing function. However, many of the devices in this field consist of unattractive mechanisms, cords, or levers attached to the exterior of the toilet, or require installation of plumbing or mechanical elements inside the toilet tank behind the bowl. Some prior toilet seat closing mechanisms have employed electric motors which of course are dangerous to use near water.

Some recent toilet seat closing devices have managed to eliminate mechanisms visible on the exterior of the toilet, but have suffered from certain drawbacks. U.S. Pat. No. 5,279,000 to Mercier et al., and No. 5,388,281 to Wiklund et al., both disclose a seat closure mechanism which is self-contained within the seat hinge on the toilet. Both devices employ a hydraulic cylinder or dashpot to slow the descent of the seat to the bowl. The closing device in the Wiklund patent uses a coil spring to bias the seat toward the closed position and start the closing motion, whereas the Mercier device uses stops mounted on the seat hinge to prevent the seat from being raised to the full 90° vertical position (stopping the seat a few degrees short), thus relying on gravity to pull the seat into motion after it is raised. Thus, the devices disclosed in the Wiklund and Mercier patents allow the seat to move slowly when it is in a vertical or near-vertical orientation, and then somewhat faster as the seat falls and the center of gravity moves laterally farther away from the hinge. However, both of these devices lack a means for adjusting the descent speed separately from the initial delay time. This arrangement makes a long delay phase (the period of slow seat motion during which the seat is sufficiently open to allow use of the toilet for urination) incompatible with a rapid descent speed. If the user "tightens" the dampening means to increase the time available to use the toilet, he necessarily slows the seat's descent over the entire range of motion, and any attempt to increase the descent speed will reduce the time available to use the toilet.

U.S. Pat. No. 5,153,946 to Yoke et al. discloses a toilet seat closing mechanism which employs a hydraulic dampener to slow the descent of the seat and a timer to adjust the delay time without affecting the descent speed. However, in this device the descent speed is not adjustable at all, which can make the device difficult to adapt for use with a toilet seat that is extremely light or heavy, or difficult to simply tune its functioning according to the user's preference. The closer is also mechanically complex, requiring two separate hydraulic chambers for regulating delay time and descent speed. Furthermore, in the preferred embodiment, the device requires substantial modification of the toilet seat to include mechanical elements for interrupting the progress of the timer under certain conditions.

Therefore, a need exists for a self-contained, compact toilet seat closing device which has a very slow initial rate of descent, providing a time delay, and a controlled final descent speed, each separately adjustable by the user, which is easily installed on a standard toilet with no addition of mechanical elements inside the tank or on the sides of the toilet, and which is as mechanically simple as possible.

It is an object of the present invention to provide an improved device for automatically closing a toilet seat after use.

It is a further object of the present invention to provide such a closing device which effectively delays the main closing action for a period easily adjustable by the user, and then closes the seat at a speed easily adjustable by the user separately from the delay duration adjustment.

It is yet a further object of the present invention to provide a closing device which is easily installed on a standard flush toilet with little or no modification to, and no installation of mechanical elements in, the toilet tank, plumbing, seat, or lid.

It is yet a further object of the present invention to provide a closing device which is compact with an unobtrusive, aesthetically pleasing appearance.

It is yet a further object of this invention to provide a closing device with the above-recited virtues which is as mechanically simple as possible.

SUMMARY OF THE INVENTION

The present invention provides a device for automatically closing an open toilet seat after an adjustable delay time to permit the user to finish using the toilet. The seat then closes at a speed which is adjustable by the user separately from the delay time.

A biasing member, which can take the form of an elastic rubber or rubber-cloth strip, or a spring of various types including a coil spring, is used to urge the open seat toward the closed position. A pneumatic or hydraulic dampener is mechanically linked to the seat and slows the seat's descent.

As the seat rotates toward the closed position it causes a reciprocating member to move inside the dampener. As the reciprocating member moves it forces a dampening fluid to flow from the main chamber of the dampener down an escape passage, through one or both of two openings, to a low pressure area within the main chamber, behind the reciprocating member. The reciprocating member is situated in the dampener such that, during the delay phase, the reciprocating member blocks and prevents the flow of the dampening fluid through one of the openings. This allows the dampening fluid to flow through only one of the openings, and this heavily restricted flow allows the seat to move very slowly throughout the delay phase. The delay phase ends when the reciprocating member passes and uncovers the second opening, permitting easier flow of the dampening fluid through both openings. This easier flow within the dampener permits the seat to travel at a faster speed until it comes to rest on the bowl in the closed position.

The dampener includes valves which can be turned from outside the dampener to vary the size of the two openings to the low pressure area of the main chamber. In this manner the valves adjust the speed of the seat during the two phases. Naturally, adjusting the speed of the seat during the delay phase is the same as adjusting the duration of the delay phase.

The dampener also includes a check valve built into the reciprocating member which permits substantially unrestricted flow of the dampening fluid through the reciprocating member as it is drawn back to the "start" position by the user's raising of the seat. This structure permits the seat to be raised with no resistance from the dampener.

DETAILED DESCRIPTION OF THE INVENTION

Figure 1:
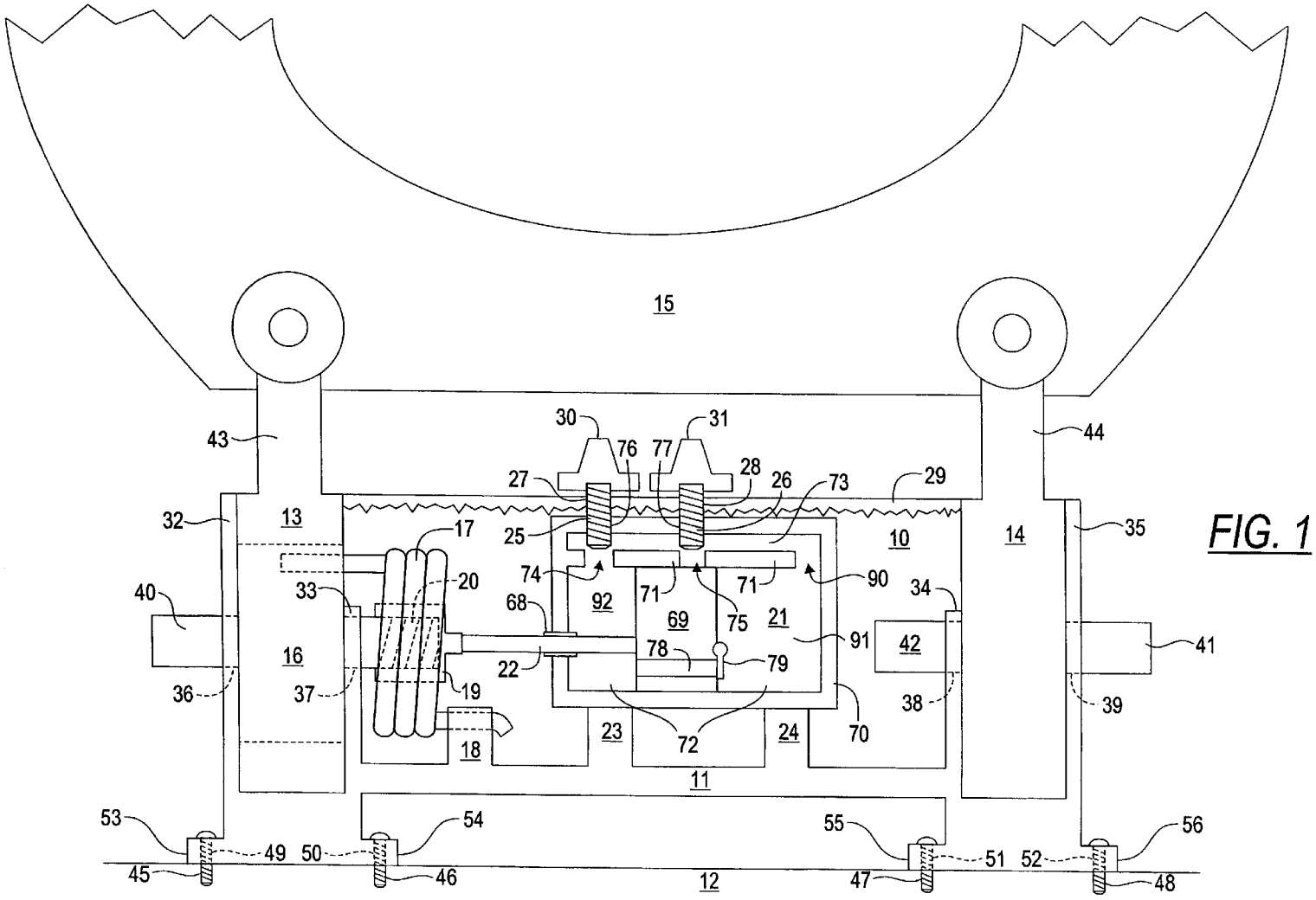
FIG. 1 is a front view of a toilet seat closing device embodying the present invention installed on a standard toilet with the seat in the vertical, open position, with the device cover and dampener shown in cutaway to expose the inner workings of the closing device and the dampener.

Surprisingly, it has been discovered that a toilet seat can be closed automatically with a device which permits a very slow, adjustable initial rate of descent (effectively providing a delay time for using the toilet) after which the seat will return to the closed position at a second faster, adjustable speed.

After the seat is raised by the user, a biasing member is used to start the seat moving toward the closed position. The biasing member should be of some kind of resilient material, such as an elastic rubber or rubber-cloth strip wound around a cam or axle rotating in concert with the seat. The invention could also employ a spring of various types, such as a coil spring, a torsion spring, or a leaf spring compressed by a cam or projection when the seat is rotated to the vertical, open position. Whichever form the biasing member takes, it is loaded, either in tension (in the case of an elastic strip) or in compression (in the case of a spring), when the user raises the seat, and the loaded biasing member will urge the open seat toward the closed position.

A pneumatic or hydraulic dampener is used to slow the descent of the seat in two stages. The first stage is marked by very slow travel of the seat, starting at the approximately vertical position and continuing for approximately 5° to 15° of seat rotation. In the second stage, which is timed to commence after the user is finished using the toilet, the seat travels at a faster speed until it comes to rest on the bowl.

This two-speed descent action is accomplished using a dampener in which a reciprocating member, mechanically linked to the seat, forces a dampening fluid to flow from a main chamber down an escape passage and through one or both of two openings to a low pressure area within the main chamber, behind the reciprocating member. The reciprocating member, main chamber, escape passage, and openings are situated such that, during the initial, low-speed phase, the reciprocating member blocks and prevents the flow of the dampening fluid through one of the openings. Thus the flow of the dampening fluid during this phase is heavily restricted, and the dampener permits the seat to advance at a slow speed. The second, higher-speed phase starts once the reciprocating member has passed and uncovered the previously-blocked opening, thus allowing the dampening fluid to flow more easily and the seat to advance more quickly until it reaches the bowl.

The dampener includes two valves which can be turned from the outside to adjust the size of the two openings leading from the escape passage to the low pressure area, and thus adjust the speed at which the seat advances during either of the two stages. Naturally, adjusting the speed of the seat during the delay phase is the same as adjusting the duration of the delay.

The dampener also includes a check valve built into the reciprocating member which permits substantially unrestricted flow of the dampening fluid through the reciprocating member as it is drawn back to the "start" position by the user's raising of the seat. This structure permits the seat to be raised with no resistance from the dampener.

DETAILED DESCRIPTION OF THE PREFERRED EMBODIMENT

Figure 2:
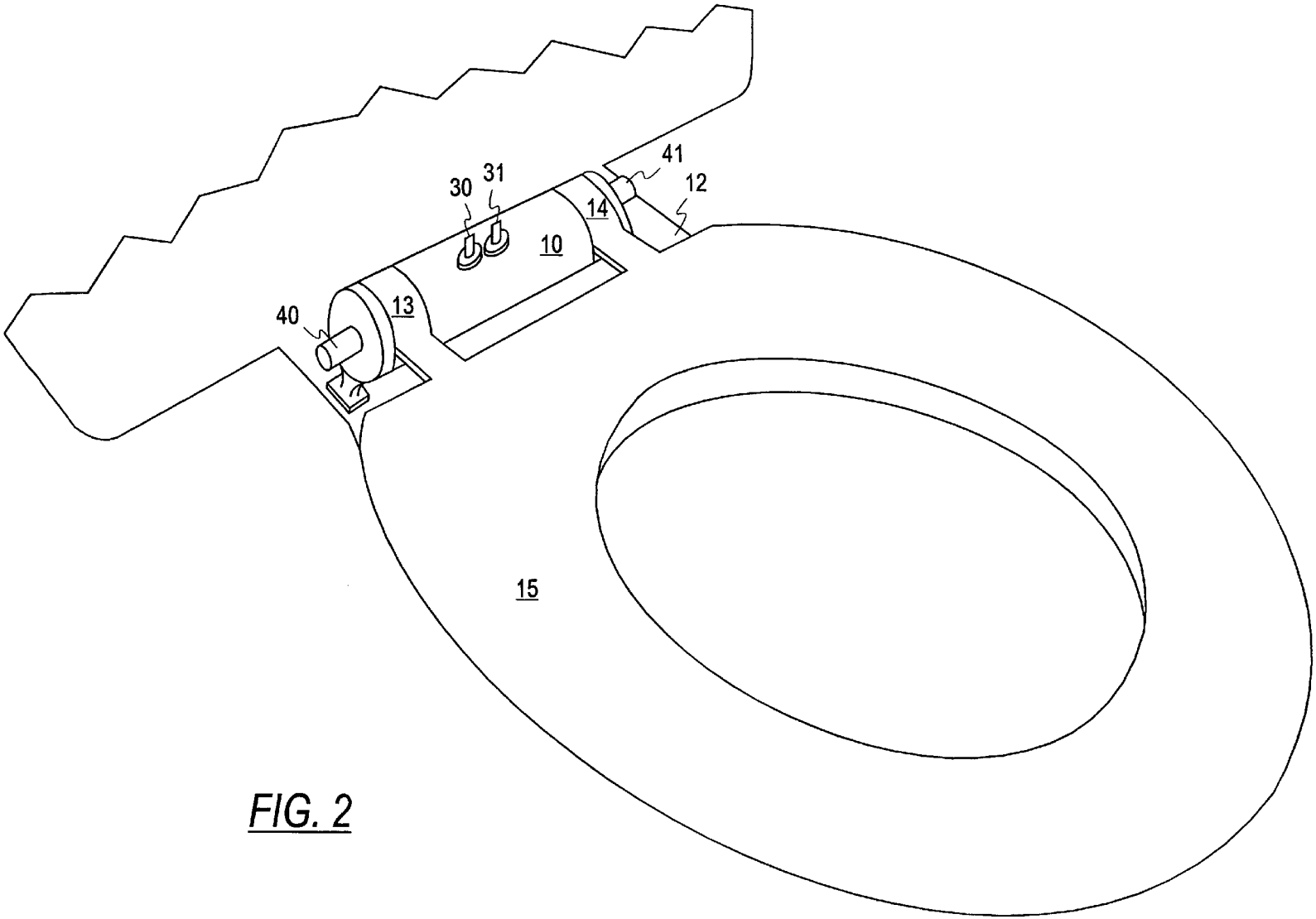
FIG. 2 is a perspective view of the toilet seat closing device with the toilet seat in the closed position.

Turning now to the drawings, FIGS. 1 and 2 depict the preferred embodiment of toilet seat closing device 10 which is in accordance with the present invention, in that the closing device is a compact unit, contained entirely within the toilet seat hinge, which automatically closes an open toilet seat, first at a very slow initial speed which effectively provides a time delay and then at a faster closing speed, and permits the user to separately adjust both the duration of the delay and the speed of the seat's descent in the second phase. Closing device 10 includes a base frame 11 which attaches to bowl 12, first and second swivel brackets 13 and 14 which attach to seat 15, a ratchet 16 within first swivel bracket 13, a coil spring 17 anchored at one end in ratchet 16 and at the other end in coil spring boss 18 which is integral to base frame 11. Worm gear 19 engages with threaded inboard axle portion 20 formed by ratchet 16, and is connected to dampener 21 via connecting rod 22. Dampener 21 is attached to dampener mounts 23 and 24 which are integral to base frame 11, and includes initial-rate valve 25 and final-rate valve 26. Both initial-rate valve 25 and final-rate valve 26 protrude through holes 27 and 28 in cover 29, and are capped by initial-rate knob 30 and final-rate knob 31.

Base frame 11 forms axle supports 32, 33, 34, and 35 which in turn form bearing surfaces 36, 37, 38, and 39, and support and contain first and second swivel brackets 13 and 14, which rotate easily upon and within bearing surfaces 36, 37, 38, and 39D (first swivel bracket 13 rotating via ratchet 16 contained therein). First swivel bracket 13 contains at its center ratchet 16 which forms first outboard axle portion 40 and threaded inboard axle portion 20. Second swivel bracket 14 is preferably of unitary construction and forms second outboard axle portion 41 and inboard axle portion 42. First and second swivel brackets 13 and 14 form arms 43 and 44 which attach to seat 15. The toilet lid (not shown) can be mounted on first and second outboard axle portions 40 and 41 which are formed by ratchet 16 and second swivel bracket 14 and protrude from either end of closing device 10. As best seen in FIG. 2, both first and second swivel brackets 13 and 14 are preferably of generally cylindrical construction so as to conform with the round shape of cover 29 and create a neat cylindrical shape for the exterior of closing device 10. Cover 29 may be constructed of plastic or other lightweight materials and in the preferred embodiment is adapted to "snap" into place on base frame 11 with no fasteners needed, although other attachment means, such as screws or spring clips, are contemplated by the present invention. A preferred means of attaching closing device 10 to the toilet is via screws 45, 46, 47, and 48 passing through holes 49, 50, 51, and 52 in flanges 53, 54, 55, and 56 at the bottom of base frame 11. However, other attachment means are contemplated by the present invention, such as nuts and bolts, high-strength adhesives, etc.

Figure 3A:
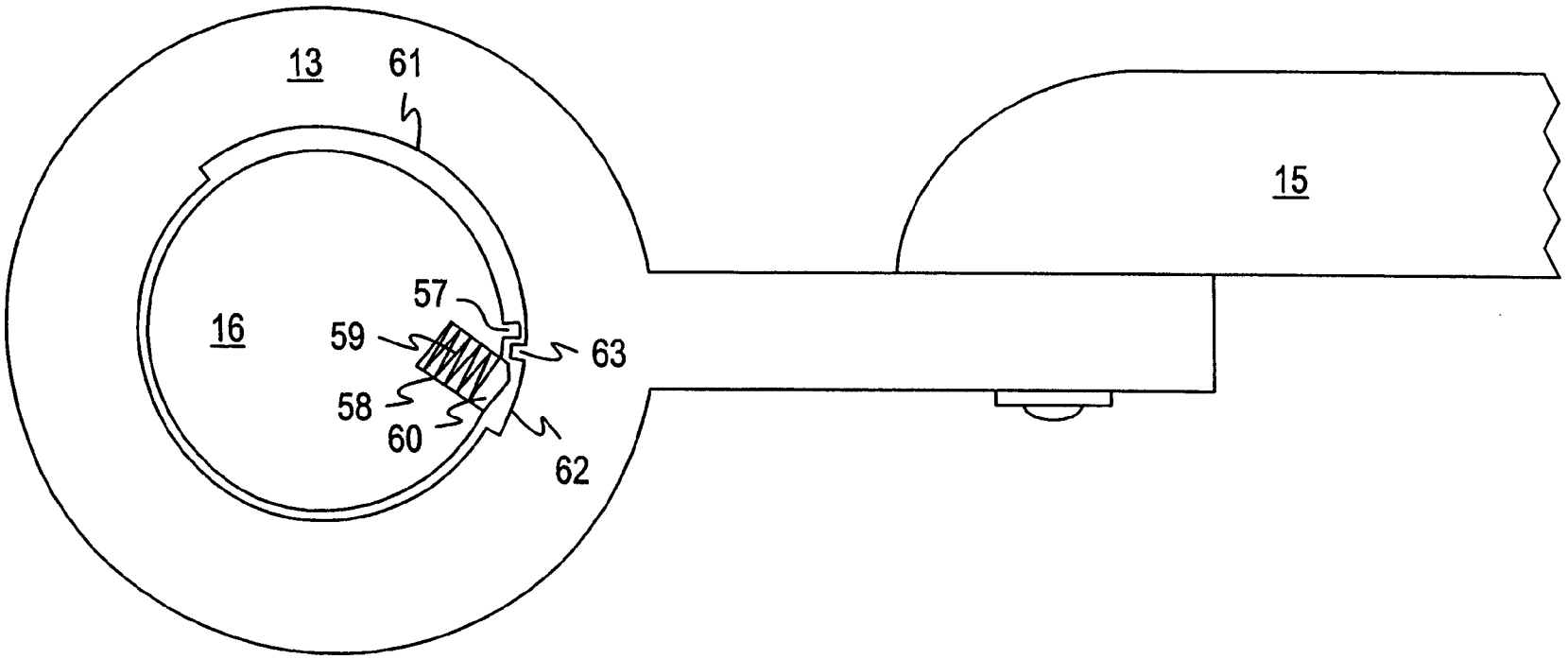
FIGS. 3*a*–3*e* are a series of side views of the ratchet and a swivel bracket which attaches to the toilet seat, showing the operation of the ratchet as the seat descends and the user forces the seat to the closed position.
Figure 4:
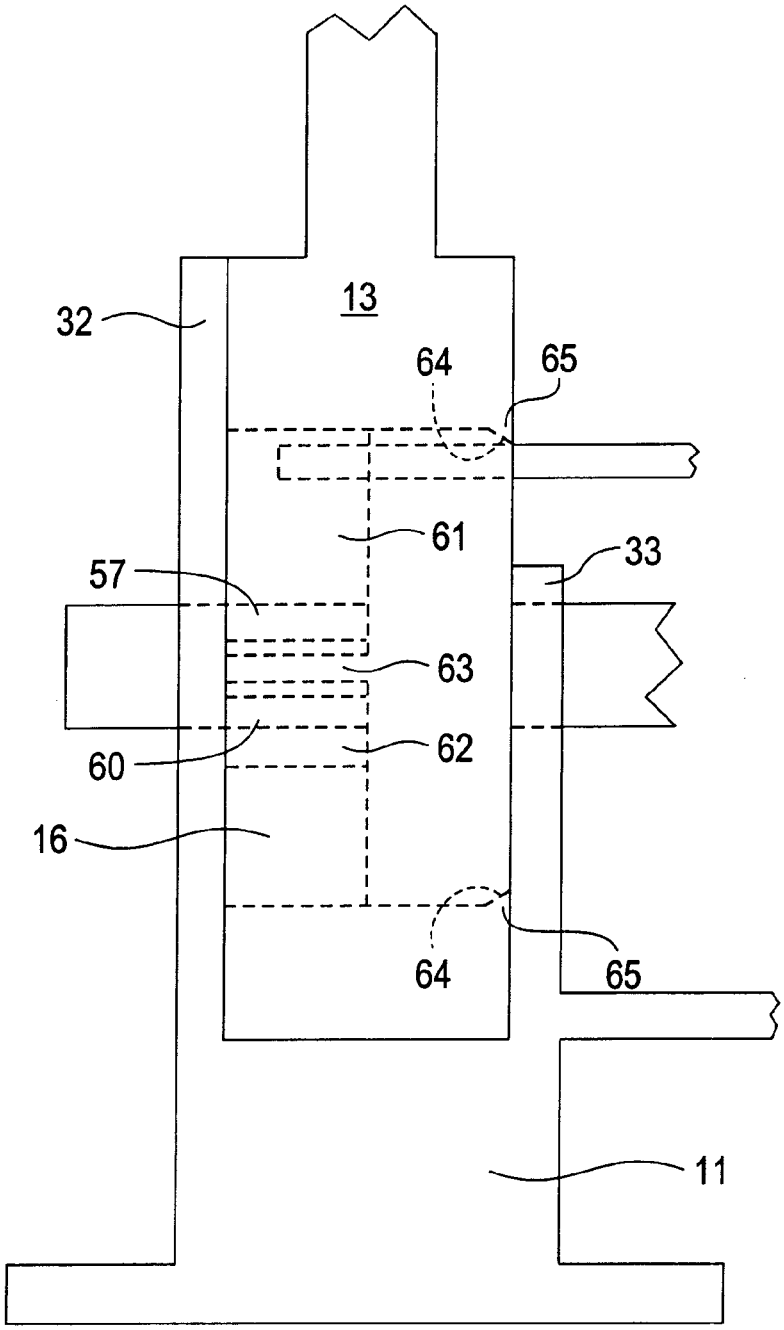
FIG. 4 is a partial front view of the toilet seat closing device showing further details of the ratchet's construction.

FIG. 3*a* shows a side view of first swivel bracket 13 which contains and is concentric with ratchet 16, which is generally cylindrical in shape and forms an inner stop 57 and a pawl socket 58 containing a pawl spring 59 and pawl 60. First swivel bracket 13 forms on its inner surface first and second gaps 61 and 62 separated by an outer stop 63. Except as noted, first swivel bracket 13 fits closely with ratchet 16 but freely turns upon and around ratchet 16, which itself freely turns within first swivel bracket 13. To allow first swivel bracket 13 and ratchet 16 to most easily rotate with respect to each other, first and second gaps 61 and 62, inner and outer stops 57 and 63, and pawl 60 preferably extend only about halfway across (see FIG. 4) the width of first swivel bracket 13 and ratchet 16, which may then fit closely together over the entire circumference of ratchet 16 for the "remaining" width of first swivel bracket 13 and ratchet 16. In the preferred form of the ratchet mechanism the rim of ratchet 16 forms a bevel 64 which mates with a projection 65 on the inner surface of first swivel bracket 13; along with axle support 32 projection 65 prevents first swivel bracket 13 from falling off ratchet 16.

Figure 3B:
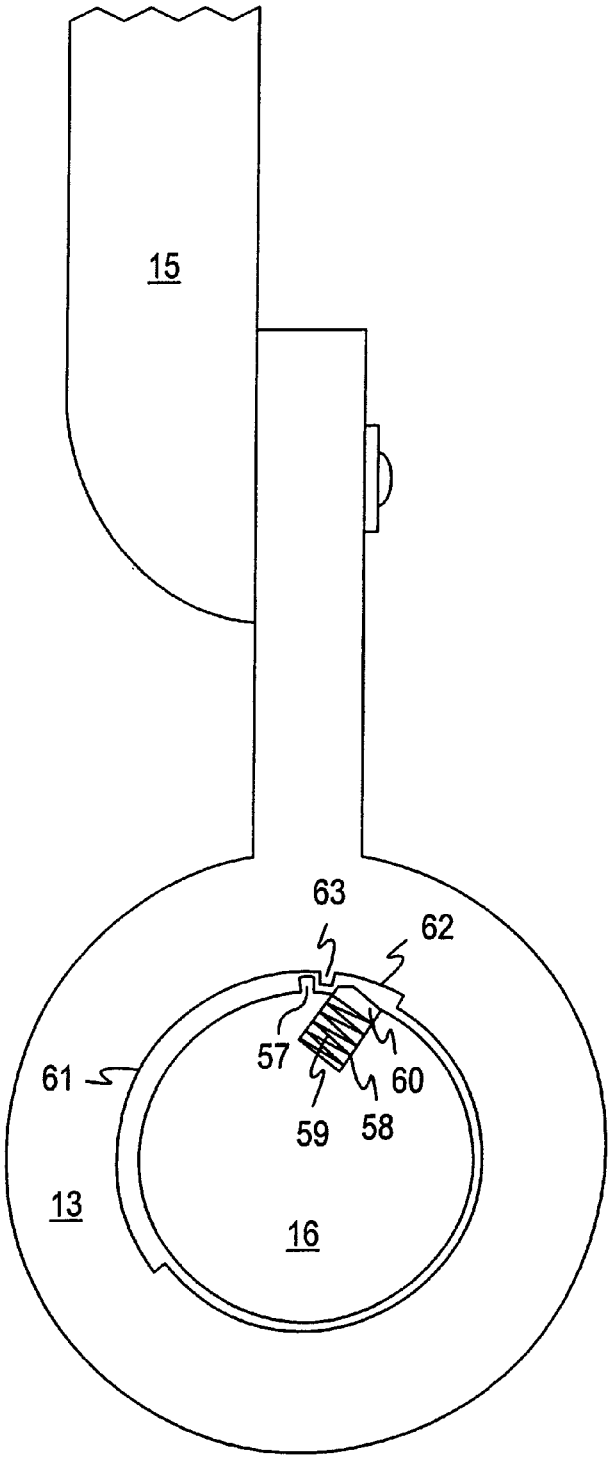
Figure 3C:
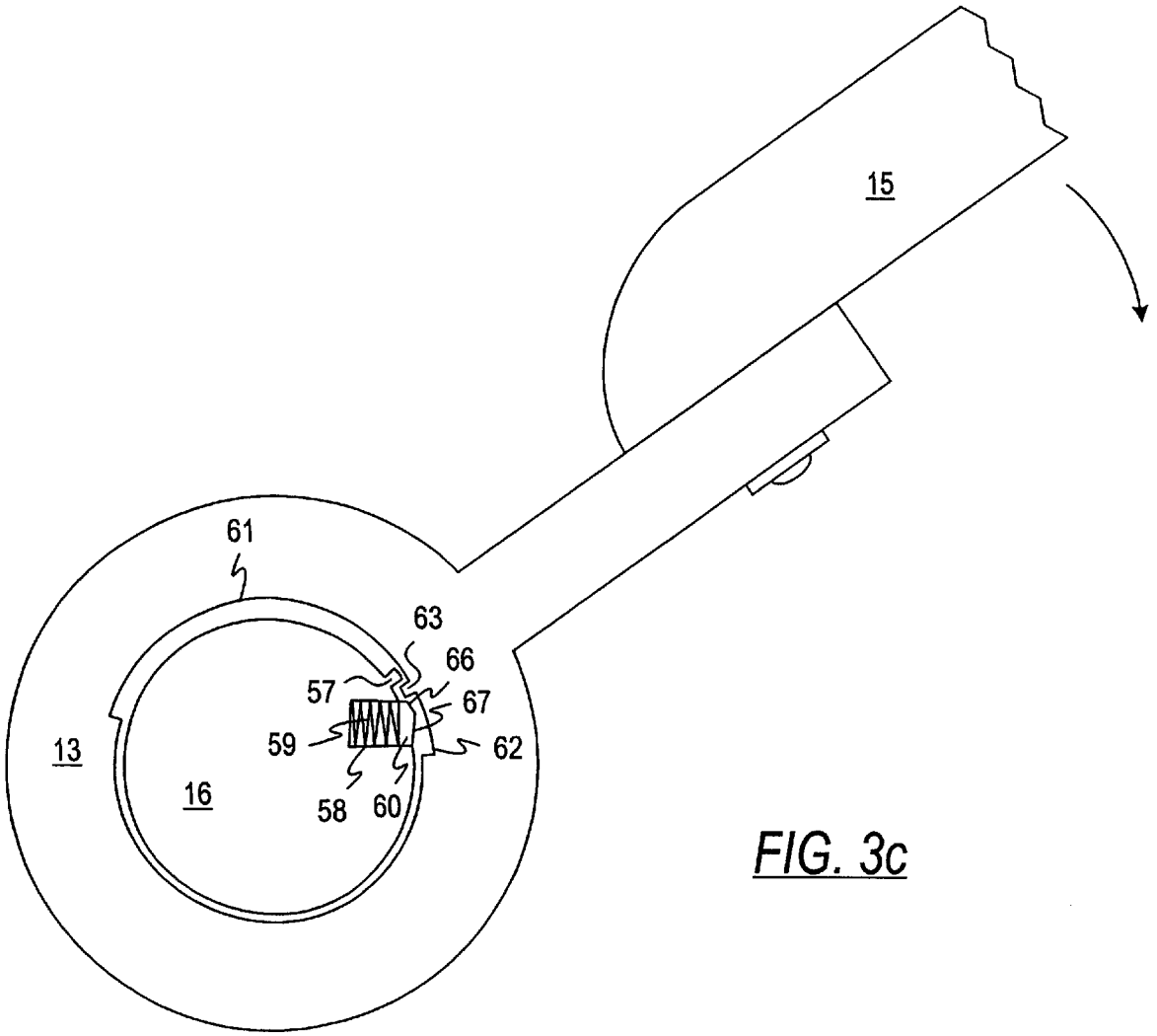

Referring now, to FIG. 3*a*, inner and outer stops 57 and 63, and pawl 60, are arranged such that when the user raises seat 15 (causing counterclockwise rotation of first swivel bracket 13 in FIG. 3*a*) outer stop 63 will engage inner stop 57 and first swivel bracket 13 and ratchet 16 will rotate together until seat 15 is in the open position as shown in FIG. 3*b*. As seat 15 starts to close (see FIG. 3*c*), the weight of seat 15 causes outer stop 63 to rest on primary slope 66 of pawl 60. Normally, the angle of primary slope 66 and force of pawl spring 59 are sufficient to prevent the weight of seat 15 from forcing outer stop 63 past pawl 60; however, pawl 60 will give way if sufficient additional force is applied manually to seat 15, as may be done in an emergency situation where the user cannot wait for the closing mechanism to bring seat 15 to the closed position upon bowl 12. Once outer stop 63 has passed pawl 60 in this manner, first swivel bracket 13 can freely rotate about ratchet 16 (see FIG. 3*d*) until seat 15 comes to rest in the closed position upon bowl 12, after which coil spring 17, limited by dampener 21, will cause ratchet 16 to rotate in the clockwise direction as shown in FIG. 3*e*. The relatively gentle angle of secondary slope 67 of pawl 60 permits pawl 60 to pass outer stop 63 under the force of coil spring 17 and come to rest when inner stop 57 meets outer stop 63, as shown in FIG. 3*a*. At this point the ratchet 16 is "reset" and ready for further use.

As best seen in FIG. 1, coil spring 17 is anchored at one end in ratchet 16 and at the other end in coil spring boss 18, and biases seat 15 toward the closed position. In the preferred embodiment, coil spring 17 surrounds worm gear 19, which rigidly connects with connecting rod 22 at one end and engages with threaded inboard axle portion 20 of ratchet 16 at the other. Thus, when seat 15 is raised ratchet 16 will rotate and worm gear 19 will advance to the left on threaded inboard axle portion 20, and when seat 15 is lowered ratchet 16 will rotate in the opposite direction and worm gear 19 will advance to the right on threaded inboard axle portion 20.

Connecting rod 22 extends into dampener 21, passing through sealed port 68, and is rigidly connected to piston 69. In the preferred embodiment, dampener 21 comprises a linear cylinder as shown in FIG. 1 and is constructed from heavy plastic, metal, or other suitable materials. Utilizing a dampening fluid such as vegetable oil or air, dampener 21 includes an outer casing 70 with an inner wall 71 separating dampener 21 into main chamber 72 and escape passage 73. Inner wall 71 forms outlet opening 90, and initial-rate opening 74 and final-rate opening 75 which align vertically with threaded bores 76 and 77 in outer casing 70. Threaded bores 76 and 77 receive initial-rate valve 25 and final-rate valve 26, which when turned by the user adjust the flow of dampening fluid through initial-rate opening 74 and final-rate opening 75. Piston 69, which fits snugly into main chamber 72 and divides main chamber 72 into first and second subchambers 91 and 92, permits the flow of dampening fluid through backflow passage 78, but only when piston 69 is drawn to the left as shown in FIG. 1. This is because check valve 79, which in the preferred embodiment is a flap hingedly connected to the front face of piston 69, covers and blocks the flow of dampening fluid through backflow passage 78 when piston 69 is drawn to the right as shown in FIG. 1. The present invention contemplates other forms for check valve 79, such as a flap type mounted within piston 69, or a ball type. This structure permits seat 15 to be raised to the open position with little resistance from dampener 21.

Figure 5:
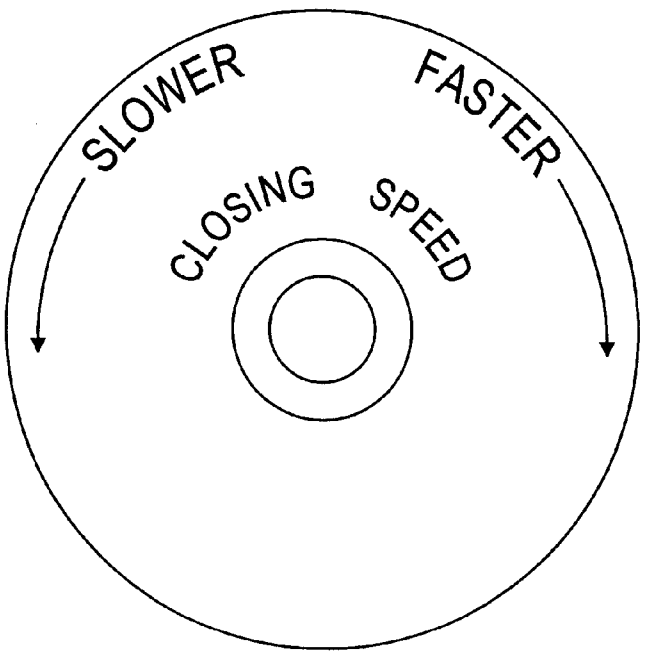
FIG. 5 is a top view of the initial-rate knob and the final-rate knob showing suggested markings for assisting the user in manipulating the knobs.
Figure 5:
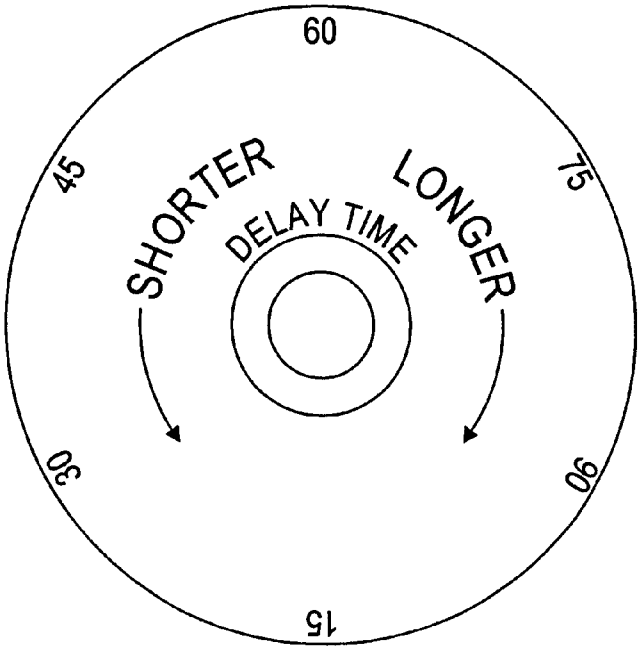

The user can adjust the duration of the initial phase and the descent speed of the final phase by turning initial-rate valve 25 and final-rate valve 26 via initial-rate knob 30 and final-rate knob 31. FIG. 5 depicts markings which could be of assistance to the user in manipulating initial-rate knob 30 and final-rate knob 31. When seat 15 is in the vertical, open position, piston 69 will be in the position shown in FIG. 1. As seat 15 closes, piston 69 is driven to the right, which forces the dampening fluid out of first subchamber 91 via outlet opening 90 and through escape passage 73. At first the flow of dampening fluid into second subchamber 92, and the speed of piston 69, is regulated by initial-rate valve 25 because final-rate opening 75 is blocked by the top of piston 69. The result is an initially slow speed for piston 69 and seat 15 as seat 15 travels through the initial phase of the seat closing process. After piston 69 advances to a point where it no longer blocks final-rate opening 75, the dampening fluid can then flow, at a faster rate, through final-rate adjustment valve 31, permitting the piston to travel at a correspondingly faster rate for the final, higher-speed phase of the seat closing process.

Figure 6:
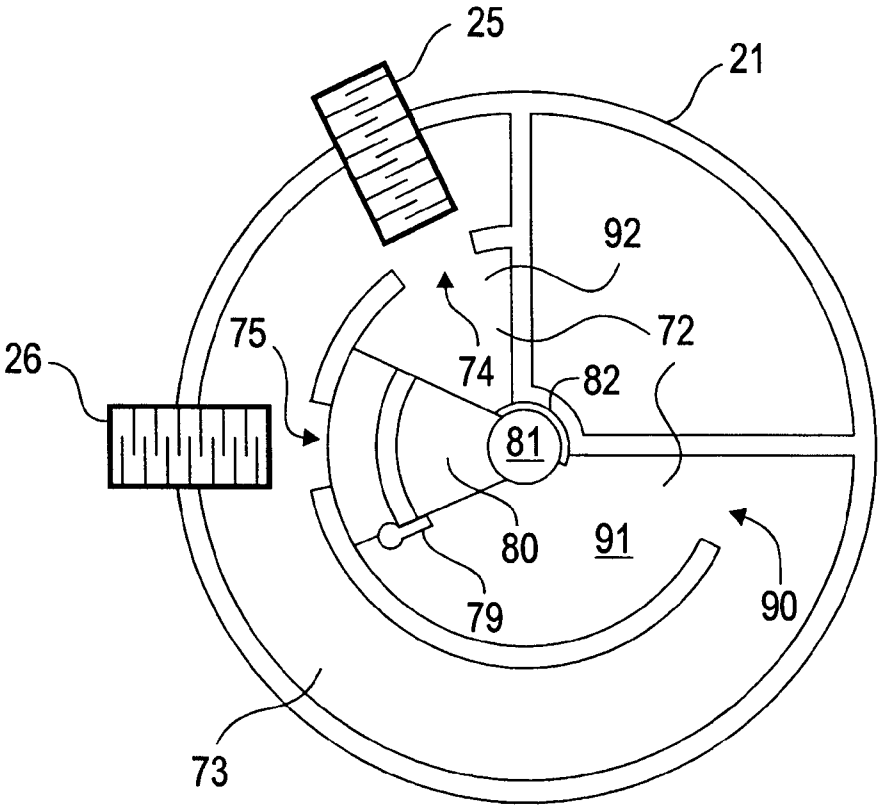
FIG. 6 is a cross section view of an alternative embodiment of the dampener employed in the toilet seat closing device.
Figure 7:
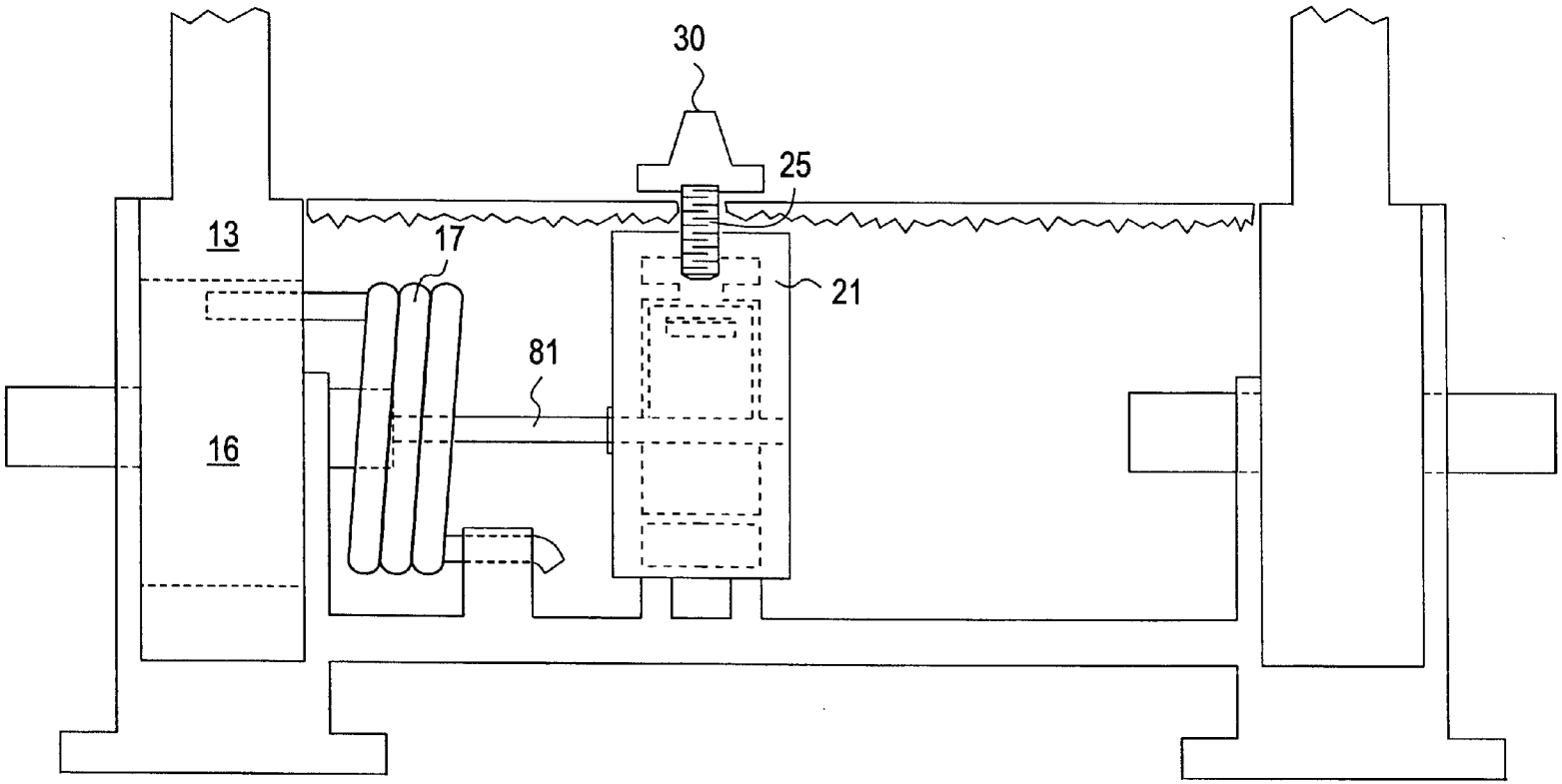
FIG.7 is a front view of the toilet seat closing device employing the alternative embodiment of the dampener.

An alternative embodiment of dampener 21, a rotary cylinder, is shown in FIGS. 6 and 7. In this type of dampener a rotor 80, driven by shaft 81, performs the same function as piston 69 in that it forces the dampening fluid out of first subchamber 91 through escape passage 73 into second subchamber 92. A seal 82 prevents dampening fluid from flowing around the shaft as rotor 80 advances, and check valve 79 permits the dampening fluid to flow back through rotor 80 as the seat is raised and rotor 80 turns in the counterclockwise direction in FIG.6. As seen in FIG. 7, shaft 81 extends out of rotary-cylinder dampener 21 and is rigidly connected to ratchet 16 so that raising or lowering seat 15 causes rotation of rotor 80 within main chamber 72. Depending on the angular position of rotor 80, the flow rate of the escaping fluid is regulated by either initial-rate valve 25

(when final-rate opening 75 is covered by the top of rotor 80, at the start of the closing process) or final-rate valve 26. Thus rotary-cylinder dampener 21 retards the closing of the seat in two phases in essentially the same manner as the linear-cylinder embodiment.

Summarizing the entire operation of closing device 10, seat 15 starts in the closed position as shown in FIG. 2. As the user raises seat 15, first swivel bracket 13 and ratchet 16 rotate together in the counterclockwise direction as shown in FIG. 3*a*. The rotation of ratchet 16 loads coil spring 17 and causes worm gear 19 to advance to the left (as shown in FIG. 1) on threaded inboard axle portion 20, pulling piston 69 to the left via connecting rod 22. As piston 69 moves to the left, the dampening fluid flows with little resistance through backflow passage 78 and check valve 79 into main chamber 72 to the right of piston 69. When seat 15 is at the vertical, open position as shown in FIG. 3*b*, closing device 10 is in the state shown in FIG. 1, with the top of piston 69 covering final-rate opening 75 and coil spring 17 loaded so as to urge seat 15 toward the closed position. Under the urging of coil spring 17, seat 15 begins to rotate toward the closed position (clockwise as shown in FIG. 3*c*), causing first swivel bracket 13 and ratchet 16 to rotate in the same direction and worm gear 19 to advance to the right as shown in FIG. 1, pushing piston 69 to the right in dampener 21. Dampener 21 at first heavily resists the urging of coil spring 17, as the dampening fluid is forced through initial-rate valve 25. This initial heavy resistance permits seat 15 to travel slowly, which marks the initial, low-speed phase of the seat closing process. After piston 69 advances far enough to uncover final-rate opening 75, the resulting faster fluid flow in dampener 21 permits seat 15 to accelerate to the final closing speed until seat 15 comes to rest in the closed position upon bowl 12.

Figure 3D:
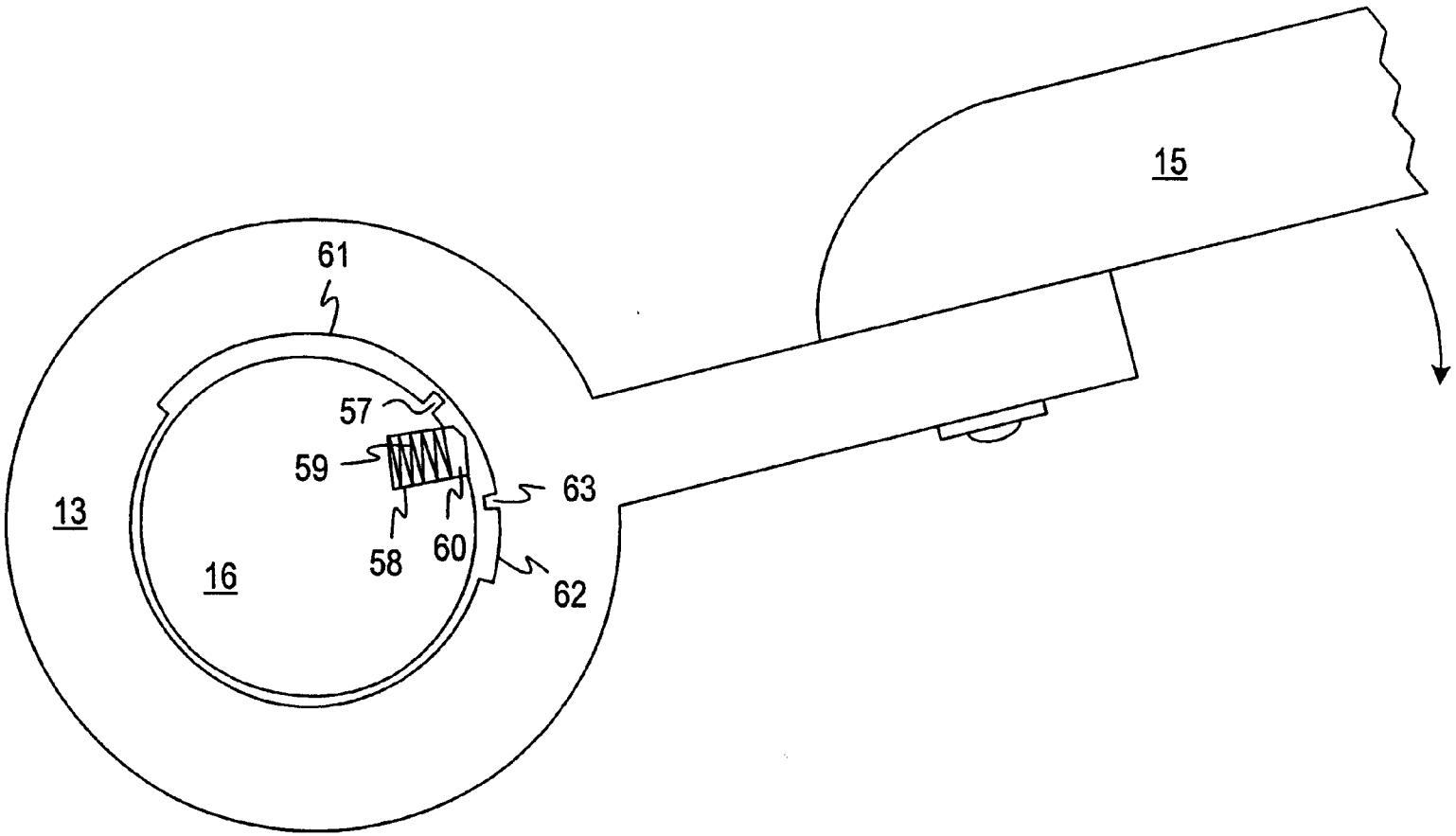
Figure 3E:
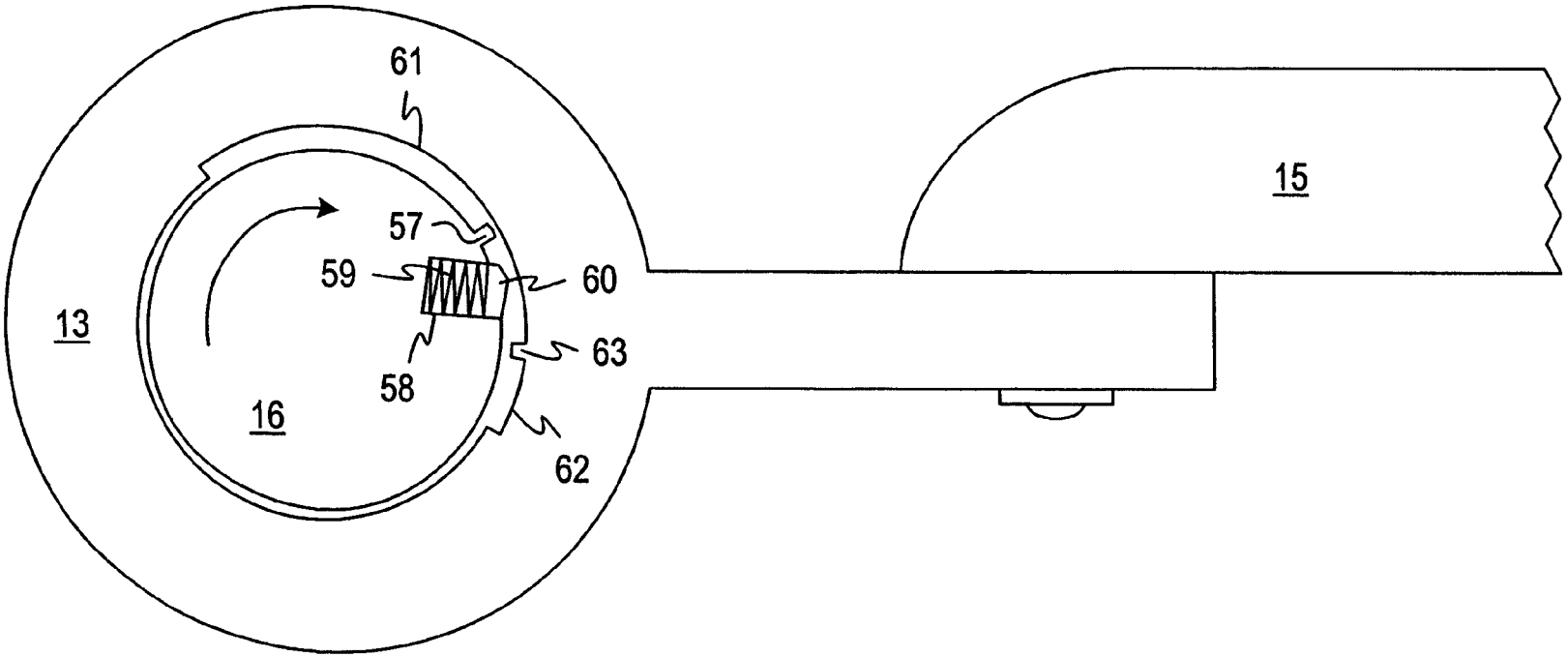

At any point during the raising or descent of seat 15, the user may force seat 15 to the closed position without damaging any of closing device 10 by pushing down on seat 15, by operation of ratchet 16 in concert with first swivel bracket 13, best shown in FIGS. 3*c* and 3*d*. The force applied by the user will cause outer stop 63 of first swivel bracket 13 to overcome the resistance of pawl spring 59 and primary slope 66 of pawl 60, located in ratchet 16. Outer stop 63 is thus forced past pawl 60 and seat 15 can freely rotate to the closed position. The urging of coil spring 17 then continues to cause ratchet 16 to rotate clockwise as shown in FIG. 3*e* and is sufficient to force pawl 60 past outer stop 63 and come to rest when inner stop 57 meets outer stop 63, as shown in FIG. 3*a*, thus resetting closing device 10 for further use.

While the invention is susceptible to various modifications and alternative forms, a specific embodiment thereof has been shown by way of example in the drawings and detailed description. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. An apparatus for automatically closing a toilet seat rotatably mounted on a toilet bowl, comprising:

a biasing member for urging the seat toward the closed position; and a dampener for retarding the advance of the seat, first at an initial rate and then at a second rate, having:

a fluid-tight outer casing;

a dampening fluid at least partially filling said outer casing;

an inner wall formed within said outer casing and separating the volume enclosed within said outer casing into a main chamber and an escape passage, said inner wall forming an outlet opening at one end of said inner wall, an initial-rate opening at the opposite end of said inner wall, and a final-rate opening located between said outlet and said initial-rate openings;

a reciprocating member movably received within said main chamber, said reciprocating member dividing said main chamber into a first subchamber and a second subchamber on either side of said reciprocating member, said reciprocating member forming with the adjacent main chamber walls a movable fluid-tight wall between said first subchamber and said second subchamber, said first subchamber and said second subchamber being in fluid connection via said escape passage and said openings in said inner wall, the range of motion of said reciprocating member being situated within said main chamber such that said reciprocating member blocks and prevents the flow of said dampening fluid through said final-rate opening in said inner wall during a portion of said reciprocating member's range of motion; and a mechanical linkage rigidly connected to said reciprocating member, said mechanical linkage extending out of said outer casing and connecting to the toilet seat so that the closing motion of the toilet seat causes said reciprocating member to move within said main chamber and force said dampening fluid to flow out of said first subchamber, through said outlet opening, through said escape passage, and into said second subchamber, said dampening fluid flowing from said escape passage into said second subchamber at first through only said initial-rate opening and, once said reciprocating member has passed and uncovered said final-rate opening, through both said initial-rate opening and said final-rate opening, permitting a faster fluid flow rate and a faster speed of advance for the toilet seat.

2. The apparatus of claim 1, wherein said biasing member comprises an elastic strip fixedly attached at one end to a member rotating in concert with the seat and fixedly attached at the other end to a stationary portion of said apparatus.

3. The apparatus of claim 1, wherein said dampener further includes means for permitting substantially unrestricted flow of said dampening fluid from said second subchamber to said first subchamber as the toilet seat is raised to the open position.

4. An apparatus for automatically closing a toilet seat rotatably mounted on a toilet bowl, comprising:

a spring for urging the seat toward the closed position; and a dampener for retarding the advance of the seat, first at an initial rate and then at a second rate, having:

a fluid-tight outer casing;

a dampening fluid at least partially filling said outer casing;

an inner wall formed within said outer casing and separating the volume enclosed within said outer casino into a main chamber and an escape passage, said inner wall forming an outlet opening at one end of said inner wall, an initial-rate opening at the opposite end of said inner wall, and a final-rate opening located between said outlet and said initial-rate openings;

an initial-rate valve and a final-rate valve received in said dampener, said initial-rate valve and said final-rate valve aligning with said initial-rate opening and said final-rate opening and adjustably restricting the flow of said dampening fluid through said initial-rate opening and said final-rate opening;

a reciprocating member movably received within said main chamber, said reciprocating member dividing said main chamber into a first subchamber and a second subchamber on either side of said reciprocating member, said reciprocating member forming with the adjacent main chamber walls a movable fluid-tight wall between said first subchamber and said second subchamber, said first subchamber and said second subchamber being in fluid connection via said escape passage and said openings in said inner wall, the range of motion of said reciprocating member being situated within said main chamber such that said reciprocating member blocks and prevents the flow of said dampening fluid through said final-rate opening in said inner wall during the portion of the range of motion of said reciprocating member coincident with the initial portion of the descent of the toilet seat; and a mechanical linkage rigidly connected to said reciprocating member, said mechanical linkage extending out of said outer casing and connecting to the toilet seat so that the closing motion of the toilet seat causes said reciprocating member to move within said main chamber and force said dampening fluid to flow out of said first subchamber, through said outlet opening, through said escape passage, and into said second subchamber, said dampening fluid flowing from said escape passage into said second subchamber at first through only said initial-rate opening and, once said reciprocating member has passed and uncovered said final-rate opening, through both said initial-rate opening and said final-rate opening, permitting a faster fluid flow rate and a faster speed of advance for the toilet seat.

5. The apparatus of claim 4, wherein said spring comprises a coil spring.

6. The apparatus of claim 4, wherein said spring comprises a torsion spring.

7. The apparatus of claim 4, wherein said spring comprises a leaf spring.

8. The apparatus of claim 4, wherein said dampener further includes means for permitting substantially unrestricted flow of said dampening fluid from said second subchamber to said first subchamber as the toilet seat is raised to the open position.

9. The apparatus of claim 4, wherein said initial-rate valve and said final-rate valve comprise threaded members threadably received in said outer casing.

10. An apparatus for automatically closing a toilet seat, comprising:

a base frame fixedly attached to the bowl;

a first swivel bracket fixedly attached to the seat and rotatably received in said base frame;

a second swivel bracket fixedly attached to the seat and rotatably received in said base frame;

a coil spring for urging the seat toward the closed position, said coil spring being anchored at one end in one of said swivel brackets and anchored at the other end in said base frame; and a dampener for retarding the advance of the seat, first at an initial rate and then at a second rate, having:

a fluid-tight outer casing;

a dampening fluid at least partially filling said outer casing;

an inner wall formed within said outer casing and separating the volume enclosed within said outer casing into a main chamber and an escape passage, said inner wall forming an outlet opening at one end of said inner wall, an initial-rate opening at the opposite end of said inner wall, and a final-rate rate opening located between said outlet and said initial-rate openings;

an initial-rate valve and a final-rate valve received in said dampener, said initial-rate valve and said final-rate valve aligning vertically with said initial-rate opening and said final-rate opening and adjustably restricting the flow of said dampening fluid through said initial-rate opening and said final rate opening;

a piston slidably received within said main chamber, said piston dividing said main chamber into a first subchamber and a second subchamber on either side of said piston, said piston forming with the adjacent main chamber walls a movable fluid-tight wall between said first subchamber and said second subchamber, said first subchamber and said second subchamber being in fluid connection via said escape passage and said openings in said inner wall, said piston including a backflow passage covered by a check valve, said backflow passage and said check valve permitting substantially unrestricted flow of said dampening fluid through said piston only from said second subchamber into said first subchamber, the range of motion of said piston being situated within said main chamber such that said piston blocks and prevents the flow of said dampening fluid through said final-rate opening in said inner wall during the portion of the range of motion of said piston coincident with the initial portion of the descent of the toilet seat; and a connecting rod rigidly connected to said piston, said connecting rod extending out of said outer casing and connecting to the toilet seat so that the closing motion of the toilet seat causes said piston to move within said main chamber and force said dampening fluid to flow out of said first subchamber, through said outlet opening, through said escape passage, and into said second subchamber, said dampening fluid flowing from said escape passage into said second subchamber at first through only said initial-rate opening and, once said piston has passed and uncovered said final-rate opening, through both said initial-rate opening and said final-rate opening, permitting a faster fluid flow rate and a faster speed of advance for the toilet seat;

an initial-rate knob fixedly attached to that portion of said initial-rate valve which protrudes from said outer casing; and a final-rate knob fixedly attached to that portion of said final-rate valve which protrudes from said outer casing.

11. The apparatus of claim 10, further including a cover removably attached to said base frame.

12. The apparatus of claim 10, wherein one of said swivel brackets contains a ratchet, said coil spring being anchored at one end in said ratchet and anchored at the other end in said base frame, said ratchet permitting the seat to be manually pushed to the closed position with no damage to said apparatus.

13. The apparatus of claim 10, wherein one of said swivel brackets forms a threaded inboard axle portion, said threaded inboard axle portion engaging with a worm gear, said worm gear moving in either direction along said threaded inboard axle portion in response to rotation of said threaded inboard axle portion and connected to said dampener so as to slow the descent of the seat as the seat closes and retract said dampener to the beginning of its cycle as the seat is opened by the user.

14. The apparatus of claim 12, wherein one of said swivel brackets forms a threaded inboard axle portion, said threaded inboard axle portion engaging with a worm gear, said worm gear moving in either direction along said threaded inboard axle portion in response to rotation of said threaded inboard axle portion and connected to said dampener so as to slow the descent of the seat as the seat closes and retract said dampener to the beginning of its cycle as the seat is opened by the user.

15. The apparatus of claim 10, wherein said first and second swivel brackets form first and second outboard axle portions upon which the toilet lid may be rotatably mounted.

16. The apparatus of claim 12, wherein said ratchet and said second swivel bracket form first and second outboard axle portions upon which the toilet lid may be rotatably mounted.

17. The apparatus of claim 10, wherein said dampener comprises a single hydraulic or pneumatic cylinder.

18. The apparatus of claim 12, wherein said first swivel bracket forms on its inside diameter an outer stop between first and second gaps and receives said ratchet, said ratchet comprising:

a generally cylindrical member rotatably received within said first swivel bracket and forming on its outside diameter an inner stop and a pawl socket, said inner stop and said outer stop permitting said ratchet and said first swivel bracket to rotate with respect to each other over a limited angular range;

a pawl slidably received within said pawl socket and having a primary slope and a secondary slope, said pawl engaging with said outer stop along said primary slope so as to prevent rotation of said ratchet and said first swivel bracket with respect to each other except when sufficient force is manually applied to the seat, said secondary slope permitting said ratchet to rotate past said outer stop until said outer stop meets said inner stop and said pawl re-engages with said outer stop along said primary slope; and a pawl spring received within said pawl socket and resisting the movement of said pawl further into said pawl socket.

19. An apparatus for automatically closing a toilet seat, comprising:

a base frame fixedly attached to the bowl;

a first swivel bracket fixedly attached to the seat and rotatably received in said base frame;

a second swivel bracket fixedly attached to the seat and rotatably received in said base frame;

a coil spring for urging the seat toward the closed position, said coil spring being anchored at one end in one of said swivel brackets and anchored at the other end in said base frame; and a dampener for retarding the advance of the seat, first at an initial rate and then at a second rate, having:

a fluid-tight outer casing;

a dampening fluid at least partially filling said outer casing;

an inner wall formed within said outer casing and separating the volume enclosed within said outer casing into a main chamber and an escape passage, said inner wall forming an outlet opening at one end of said inner wall, an initial-rate opening at the opposite end of said inner wall, and a final-rate opening located between said outlet and said initial-rate openings;

an initial-rate valve and a final-rate valve received in said dampener, said initial-rate valve and said final-rate valve aligning radially with said initial-rate opening and said final-rate opening and adjustably restricting the flow of said dampening fluid through said initial-rate opening and said final-rate opening;

a rotor rotatably received within said main chamber, said rotor dividing said main chamber into a first subchamber and a second subchamber on either side of said rotor, said rotor forming with the adjacent main chamber walls a movable fluid-tight wall between said first subchamber and said second subchamber, said first subchamber and said second subchamber being in fluid connection via said escape passage and said openings in said inner wall, said rotor including a backflow passage covered by a check valve, said backflow passage and said check valve permitting substantially unrestricted flow of said dampening fluid through said rotor only from said second subchamber into said first subchamber, the range of motion of said rotor being situated within said main chamber such that said rotor blocks and prevents the flow of said dampening fluid through said final-rate opening in said inner wall during the portion of the range of motion of said rotor coincident with the initial portion of the descent of the toilet seat;

a shaft rigidly connected to said rotor, said shaft extending out of said outer casing and connecting to the toilet seat so that the closing motion of the toilet seat causes said rotor to rotate within said main chamber and force said dampening fluid to flow out of said first subchamber, through said outlet opening, through said escape passage, and into said second subchamber, said dampening fluid flowing from said escape passage into said second subchamber at first through only said initial-rate opening and, once said rotor has passed and uncovered said final-rate opening, through both said initial-rate opening and said final-rate opening, permitting a faster fluid flow rate and a faster speed of advance for the toilet seat;

an initial-rate knob fixedly attached to that portion of said initial-rate valve which protrudes from said outer casing; and a final-rate knob fixedly attached to that portion of said final-rate valve which protrudes from said outer casing.

20. The apparatus of claim 19, further including a cover removably attached to said base frame.

21. The apparatus of claim 19, wherein one of said swivel brackets contains a ratchet, said coil spring being anchored at one end in said ratchet and anchored at the other end in said base frame, said ratchet permitting the seat to be manually pushed to the closed position with no damage to said apparatus.

22. The apparatus of claim 19, wherein one of said swivel brackets forms a threaded inboard axle portion, said threaded inboard axle portion engaging with a worm gear, said worm gear moving in either direction along said threaded inboard axle portion in response to rotation of said threaded inboard axle portion and connected to said dampener so as to slow the descent of the seat as the seat closes and retract said dampener to the beginning of its cycle as the seat is opened by the user.

23. The apparatus of claim 21, wherein one of said swivel brackets forms a threaded inboard axle portion, said threaded inboard axle portion engaging with a worm gear, said worm gear moving in either direction along said threaded inboard axle portion in response to rotation of said threaded inboard axle portion and connected to said dampener so as to slow the descent of the seat as the seat closes and retract said dampener to the beginning of its cycle as the seat is opened by the user.

24. The apparatus of claim 19, wherein said first and second swivel brackets form first and second outboard axle portions upon which the toilet lid may be rotatably mounted.

25. The apparatus of claim 21, wherein said ratchet and said second swivel bracket form first and second outboard axle portions upon which the toilet lid may be rotatably mounted.

26. The apparatus of claim 19, wherein said dampener comprises a single hydraulic or pneumatic cylinder.

27. The apparatus of claim 21, wherein said first swivel bracket forms on its inside diameter an outer stop between first and second gaps and receives said ratchet, said ratchet comprising:

a generally cylindrical member rotatably received within said first swivel bracket and forming on its outside diameter an inner stop and a pawl socket, said inner stop and said outer stop permitting said ratchet and said first swivel bracket to rotate with respect to each other over a limited angular range;

a pawl slidably received within said pawl socket and having a primary slope and a secondary slope, said pawl engaging with said outer stop along said primary slope so as to prevent rotation of said ratchet and said first swivel bracket with respect to each other except when sufficient force is manually applied to the seat, said secondary slope permitting said ratchet to rotate past said outer stop until said outer stop meets said inner stop and said pawl re-engages with said outer stop along said primary slope; and a pawl spring received within said pawl socket and resisting the movement of said pawl further into said pawl socket.

* * * * *

UNITED STATES PATENT AND TRADEMARK OFFICE

CERTIFICATE OF CORRECTION

| | | |
|---|---|---|
| PATENT NO. | : | 5,974,595 |
| DATED | : | November 2, 1999 |
| INVENTOR(S) | : | Robert J. McCabe |

It is certified that error appears in the above-identified patent and that said Letters Patent is hereby corrected as shown below:

Column 8, line 62: Delete "casino" and insert --casing--.

Signed and Sealed this

Twenty-third Day of May, 2000

*Attest:*

Q. TODD DICKINSON

*Attesting Officer*

*Director of Patents and Trademarks*